US011780259B2

(12) United States Patent
Wang et al.

(10) Patent No.: US 11,780,259 B2
(45) Date of Patent: Oct. 10, 2023

(54) CARRIAGE BASES

(71) Applicant: Hewlett-Packard Development Company, L.P., Spring, TX (US)

(72) Inventors: Deyang Wang, Singapore (SG); Adnil San Dela Pena Sazon, Singapore (SG); Cherng Linn Teo, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 138 days.

(21) Appl. No.: 17/396,494

(22) Filed: Aug. 6, 2021

(65) Prior Publication Data

US 2021/0362534 A1 Nov. 25, 2021

Related U.S. Application Data

(63) Continuation-in-part of application No. 17/288,527, filed as application No. PCT/US2019/035947 on Jun. 7, 2019.

(51) Int. Cl.
*B43K 23/00* (2006.01)

(52) U.S. Cl.
CPC ..... *B43K 23/00* (2013.01)

(58) Field of Classification Search
CPC ..... B41J 2/17523; B41J 2/1752; B41J 2/175; B43K 23/00
See application file for complete search history.

(56) References Cited

U.S. PATENT DOCUMENTS

| | | | |
|---|---|---|---|
| 5,102,084 A | 4/1992 | Park | |
| 6,003,981 A | 12/1999 | Cameron et al. | |
| 6,155,678 A | 12/2000 | Komplin et al. | |
| 6,270,204 B1 | 8/2001 | Barrett et al. | |
| 6,367,918 B1 | 4/2002 | Heiles et al. | |
| 9,132,228 B2 | 9/2015 | Yan | |
| 9,132,649 B2 * | 9/2015 | Petersen | B41J 2/17509 |
| 2013/0293637 A1 | 11/2013 | Bacon et al. | |
| 2019/0091682 A1 | 3/2019 | Drews et al. | |
| 2020/0316950 A1 | 10/2020 | O'Reilly et al. | |

FOREIGN PATENT DOCUMENTS

| | | |
|---|---|---|
| CN | 103328216 A | 9/2013 |
| CN | 203510980 U | 4/2014 |
| CN | 107000439 A | 8/2017 |
| CN | 109311326 A | 2/2019 |
| CN | 109580292 A | 4/2019 |
| WO | WO-2016048270 A1 | 3/2016 |

OTHER PUBLICATIONS

EPSON 1400 Continuous Ink System Install CISS ~ photo ~ 1 page ~ date unknown.

* cited by examiner

*Primary Examiner* — An H Do
(74) *Attorney, Agent, or Firm* — Brooks, Cameron & Huebsch, PLLC

(57) ABSTRACT

A fluid ejection system can include a carriage base that includes a first pen slide at a bottom rear of the carriage base, a second pen slide at a front of the carriage base, and a pen guide at a top rear of the carriage base, the pen guide can include a guide portion to engage a substantially vertical portion of a back corner of a pen, a blocker portion to engage a substantially horizontal portion of the top back corner of the pen, and a pen guide corner formed between the guide portion and the blocker portion to hold a top back corner of a pen substantially in place during an angular loading of the pen.

15 Claims, 12 Drawing Sheets

CARRIAGE BASES

RELATED APPLICATIONS

This application is a continuation-in-part of U.S. patent application Ser. No. 17/288,527 entitled "Rotating Manifolds," filed Apr. 24, 2021, which is a national stage entry from PCT/US2019/035947 entitled "Rotating Manifolds," filed Jun. 7, 2019, which are all hereby incorporated by reference in their entirety.

BACKGROUND

In some markets, there has been an increase in demand for Continuous Ink Supply System (CISS) fluid ejection systems. Continuous Ink Supply Systems (CISS) fluid ejection systems may include relatively large reservoirs of printing fluid (e.g., ink), which reservoirs are fluidically connected to pens. The pens perform the printing operation and contain a lesser amount of printing fluid.

BRIEF DESCRIPTION OF THE DRAWINGS

The accompanying drawings illustrate various examples of the principles described herein and are a part of the specification. The illustrated examples do not limit the scope of the claims.

Figure 1:
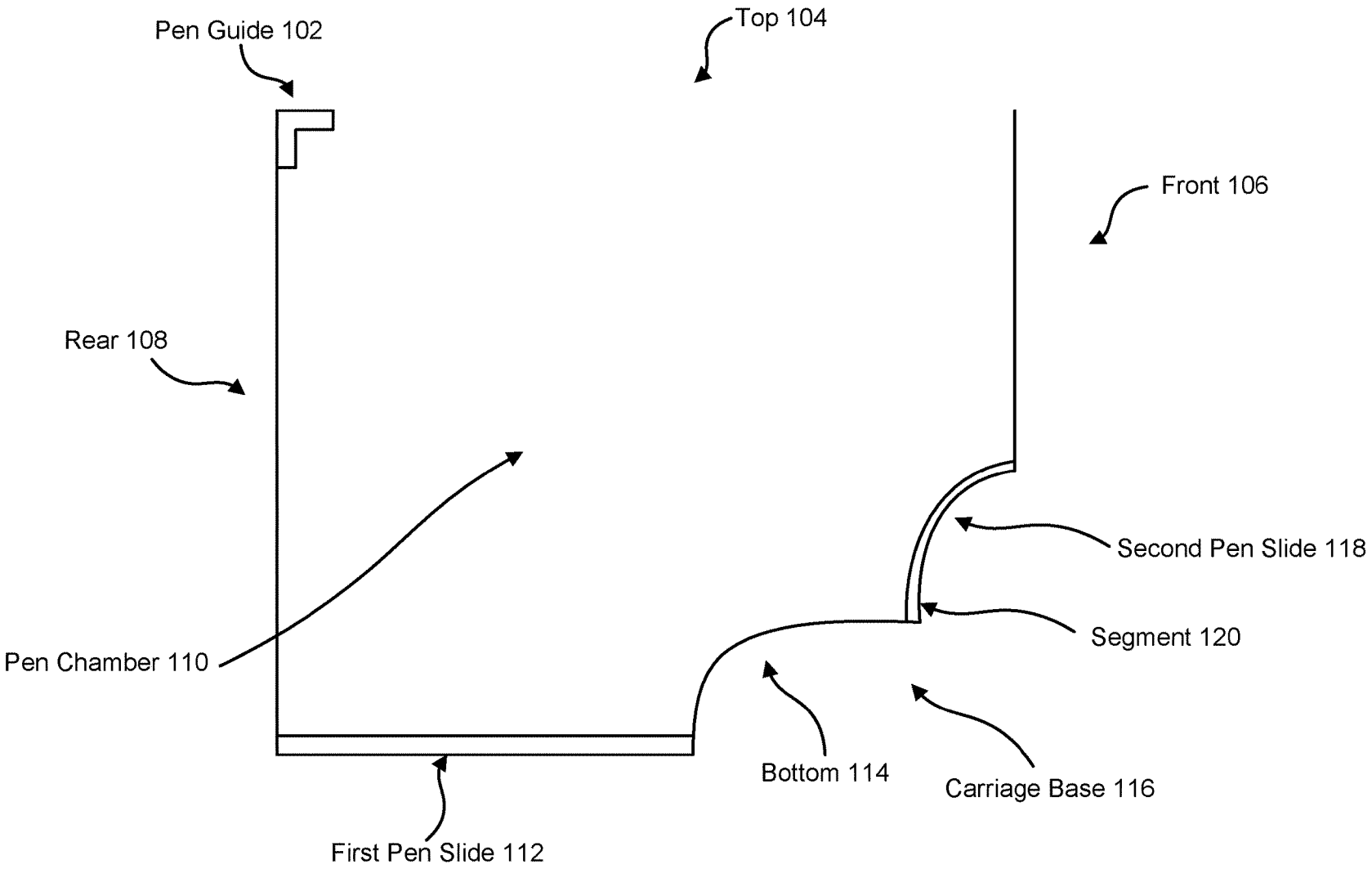
FIG. 1 is a side elevational view illustrating an example of a carriage base for a fluid ejection system consistent with this specification.

Throughout the drawings, identical reference numbers designate similar, but not necessarily identical, elements. The figures are not necessarily to scale, and the size of some parts may be exaggerated or minimized to more clearly illustrate the example shown. The drawings provide examples and/or implementations consistent with the description. However, the description is not limited to the examples and/or implementations shown in the drawings.

DETAILED DESCRIPTION

Continuous Ink Supply Systems (CISS) fluid ejection systems include relatively large reservoirs of printing fluid (e.g., ink), which reservoirs are fluidically connected to pens. The pens perform the printing operation and contain a lesser amount of printing fluid. In some examples, the pens may be modified from disposable pens used in non-CISS fluid ejection systems. In other examples, the pens may be the same as the disposable pens. In practice, it is useful to increase the quality of the pens due to the number of ejection cycles the pens will experience. That is, over time, pens deteriorate in their ability to accurately and reliable eject the printing fluid. That is, because the pens may be at a point of failure and in some examples are not replaced at periodic intervals, the pen quality is a factor for system life. Replacing the pens on a CISS fluid ejector system may be more challenging than on a system with disposable pens, due to the fluid connection between the fluid reservoir of the CISS system and the pen.

Accordingly, to transfer the fluid between the reservoir and the pens, a manifold may be used. In some examples, the manifold interfaces with a fluidic interface which connects the printing fluid reservoirs to the pens.

In general, another feature valued in printing systems is small size, which may include a smaller width, length, and/or depth. A smaller size allows the printing system to be placed in smaller areas and thereby to occupy less desk and/or floor space. A smaller size device may also reduce shipping and storage costs.

One of the size constraints for a printing system with a CISS is an amount of space needed for loading the pens into the system. For example, it may be desirable to load the pens at the customer site and/or at a display location rather than at a factory. This avoids the risk of the pens leaking printing fluid, being damaged, and/or other undesirable outcomes of shipping the system with the pens preinstalled.

Installing the pens may include gaining access to the area underneath the manifold and/or a fluidic interface. The pen may then be inserted through an opening and into the location underneath the manifold. Such a process may be complex and time-intensive, specifically when performed at a customer site by a customer who may not be familiar with the printing system. The pen may include a portion designed to be penetrated by the fluidic interface. In an example, this is a silicone or flexible plastic portion which is penetrated by the needle.

Accordingly, the present specification describes using a manifold with a rotational connector. Doing so allows the manifold to rotate out of the way to allow the pens to be installed. The manifold then rotates back and secures the pens in their locations. This alleviates the need to preinstall the pens.

In one example, the manifold is first rotated into place to secure the pens. The fluidic interface is then placed down onto the pens to connect the CISS to the pens. In this way, the smaller footprint achieved with a rotational connection on the manifold is compatible with minimized opening size between the fluidic interface and the pens. The result is a fluid ejection system with a reduced size, especially in depth, which is able to use the body portion of an existing fluid ejection system and support a CISS fluidic interface on top.

In some examples, during front pen installation the pen's pads (e.g., electrical contacts arranged to form an electrical connection with contacts of the fluid ejection system) may become worn. As a pen's pads become more worn, they may become less reliable, and may suffer from pen rejection. In the examples shown herein for the angular loading of a pen into a carriage base, the wear on the pen's pads may be reduced.

Turning now to the figures, FIG. 1 is a side elevational view illustrating an example of a carriage base 116 for a fluid ejection system consistent with this specification. The carriage base 116 may have a top portion 104, a bottom portion 114, a front portion 106 and a rear portion 108. The carriage base 116 may include a pen chamber 110 where a pen is placed. The carriage base 116 structure may form the pen chamber 110. The carriage base 116 may include a first pen slide 112 at the bottom rear of the carriage base 116. The carriage base 116 may include a second pen slide 118 at the front 106 of the carriage base 116. A pen guide 102 at the top rear of the carriage base 116 may serve to hold a top back corner of a pen during an angular loading of the pen.

In one example, the second pen slide 118 may be positioned higher than the first pen slide 112 on the carriage base 116. In addition, the first pen slide 112 may be substantially horizontal. For example, the first pen slide 112 may be arranged to correspond to a lower plane of the carriage base 116. This lower plane may be parallel to a plane formed by print media passing beneath the pen. However, for installation of the pen, the carriage base 116 may be presented to the user at a slight angle, such as to facilitate pen installation. Thus, such variations in carriage angle to accommodate pen installation are understood to fall under the meaning of "substantially horizontal." The second pen slide 118 may include a segment 120 that is substantially vertical. As shown in FIG. 1, the second pen slide 118 may further include a portion that curves away from the segment 120 toward the front 106 of the carriage base 116. In one example, the portion may curve away from the first pen slide. The substantially vertical orientation of the segment 120 of the second pen slide 118 is understood to encompass variations in carriage angle to accommodate pen installation. Additionally, in cases in which the second pen slide 118 is not a straight line, such as illustrated in FIG. 1, the term "substantially vertical" refers to the extremity of the second pen slide 118 closest to the first pen slide (i.e., the segment 120) and from the extremity of the second pen slide 118 a substantially vertical plane may be formed.

Figure 2:
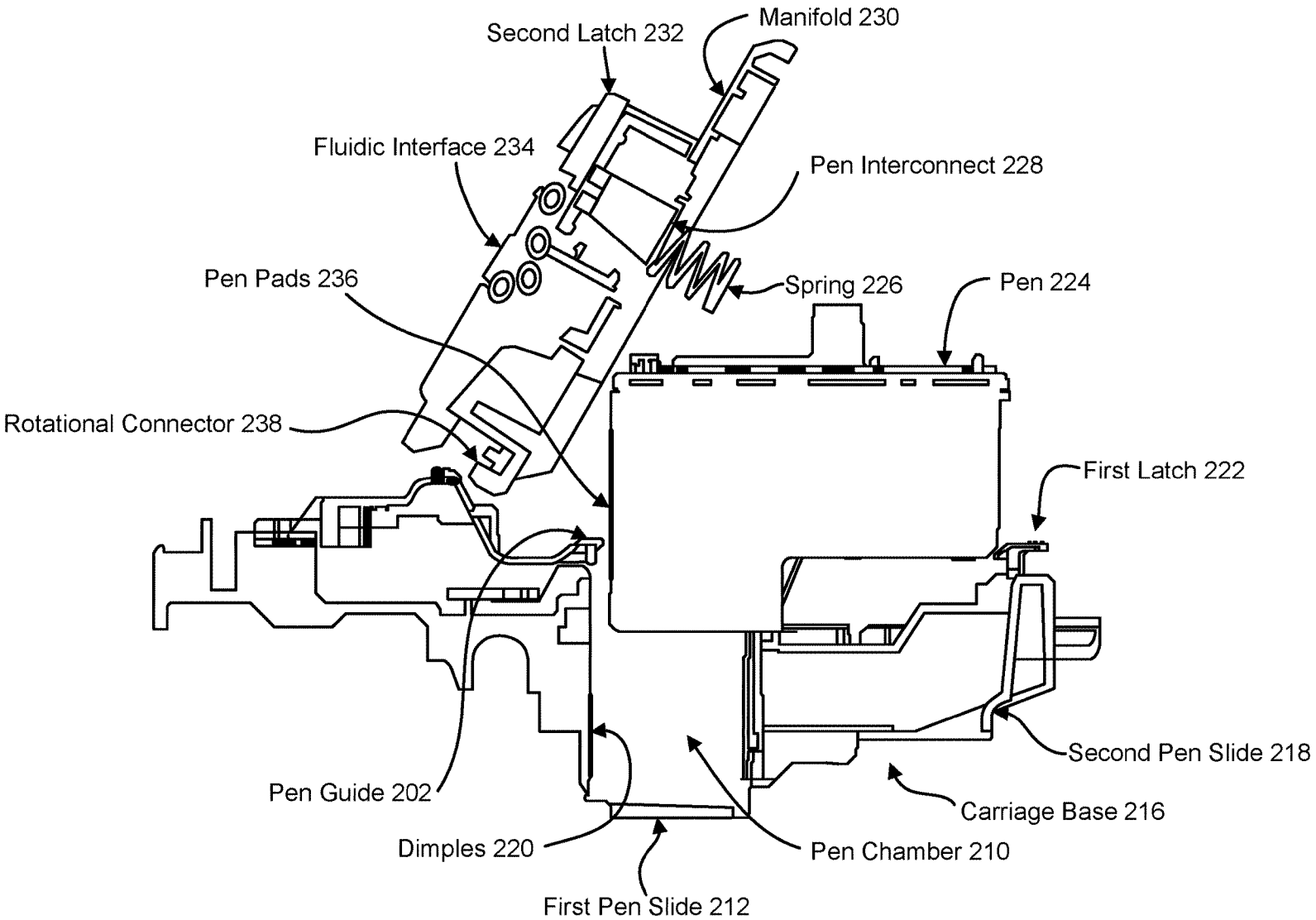
FIG. 2 is a side elevational view illustrating an example of a carriage base, manifold, and pen for a fluid ejection system consistent with this specification.

FIG. 2 is a side elevational view illustrating an example of a carriage base 216, manifold 230 and pen 224 for a fluid ejection system consistent with this specification. The carriage base 216 may include a first pen slide 212 at the bottom rear of the carriage base 216. The carriage base 216 may include a second pen slide 218 at the front of the carriage base 216. The carriage base 216 may form a pen chamber 210 for the pen 224. A pen guide 202 at the top rear of the carriage base 216 may serve to hold a top back corner of a pen 224 during an angular loading of the pen 224.

The manifold 230 of the system retains the pens 224 in place. The carriage base may be attached to the manifold by the rotational connector 238. As described above, the manifold 230 rotates about the rotational connector 238. That is, the rotational connector 238 allows the manifold 230 to rotate out of position in order to allow loading of the pens 224 into the printing system. This allows a larger access area compared with manifolds 230 lacking a rotational connector 238.

The rotational connector 238 may allow separation between the manifold 230 and the fluid ejection system. In an example, the rotational connector 238 is a pivot. Specifically, in an example, the rotational connector 238 is a hinge. As another specific example, the rotational connector 238 is a pivot which includes two pins extending from opposite sides of the manifold 230, the two pins sharing an axis of rotation, which axis of rotation may be part of the printing system. In another example, the manifold 230 has a pair of pins which snap into a C-shaped connection to form the rotational connector 238. In yet another example, the manifold 230 has a single pin which forms an axis of the rotational connector 238. The single pin may snap into place on the manifold 230 and fluid ejection system. The manifold 230 may have a U-shaped feature, allowing the manifold 230 to rotate around the axis of rotation. The rotational connector 238 may be a hinge formed from a slot and an associated tab. The rotational connector 238 may be a living hinge.

The pen interconnects 228 are to receive the pens 224 inserted therein and in some cases provide features to stabilize the positions of the pens 224 in the fluid ejection system. The pen interconnects 228 include openings passing through the manifold 230. The openings allow the fluidic interface 234 to connect to the pens 224 when the fluidic interface 234 is installed. While any number of pen interconnects 228 may be used, in one particular example four pen interconnects 228 are present on the manifold 230, one pen interconnect 228 for black printing fluid and three pen interconnects 228 for other printing fluids. For purposes of illustration, FIG. 2 illustrates one pen interconnect 228.

The needle which passes through the manifold 230 into the pen 224 may include an internal valve. The internal valve opens when the needle is pushed down into place. When the needle retracts, for example, as the fluidic interface 234 is unlatched and moved upward, the valve may close. In this manner, printing fluid may be controlled between the reservoir and the associated pen 224.

The first latch 222 secures the manifold 230 against the pen 224 below once the pens have been installed. The pen interconnects 228 may contact the pen 224 to hold the pen 224 adjacent the manifold 230. In some examples, the first latch 222 may include a spring such that when the first latch 222 is released, the spring pushes the manifold 230 away from the body of the fluid ejection system. If this happens with the fluidic interface 234 latched onto the manifold 230, the needles may damage the pens 224, creating a larger opening which allows weeping of printing fluid and/or other issues.

The second latch 232 retains and/or secures the fluidic interface 234 against the manifold 230. The second latch 232 may include a spring 226 which, when the second latch 232 is released, causes the fluidic interface 234 to move away from the manifold 230.

In order to avoid user error from rotating the manifold 230 without undoing the second latch 232, in some examples, the release for the first latch 222 automatically releases the second latch 232. The release for the first latch 222 may release the second latch 232 prior to releasing the first latch 222 to provide time for the needles to retract prior to rotation of the manifold 230 about the rotational connector 238. The release on the first latch 222 may include an intermediate stop and/or other feature to slow sliding of the first latch 222.

Releasing the second latch 232 may block printing fluid from moving from a reservoir to the associated pen interconnect 228. For example, the spring 226 which separates the fluidic interface 234 from the manifold 230 may also press a bar across the fluidic connections of the fluidic interface 234. In some examples, releasing the second latch 232 reduces pressure on the fluidic interface conduits and/or reservoirs for the CISS to cause the printing fluid to pull back into the fluidic interface 234. This may reduce leakage during equipment when the latches are opened to perform maintenance and/or other activities.

The pen 224 may have pen pads 236 on the rear of the pen 224. The pen pads 236 serve to contact the dimples 220 (e.g., raised electrical contacts) for electrical connection between the pen 224 and the printer. The pen pads 236 may have reduced wear because of the angular loading described with examples herein. The carriage base 216 rear wall may include dimples 220. The dimples 220 serve as contact points to connect with the pen pads 236 electrically and another end of the dimples 220 are linked with the carriage PCA (printed circuit assembly).

Figure 3:
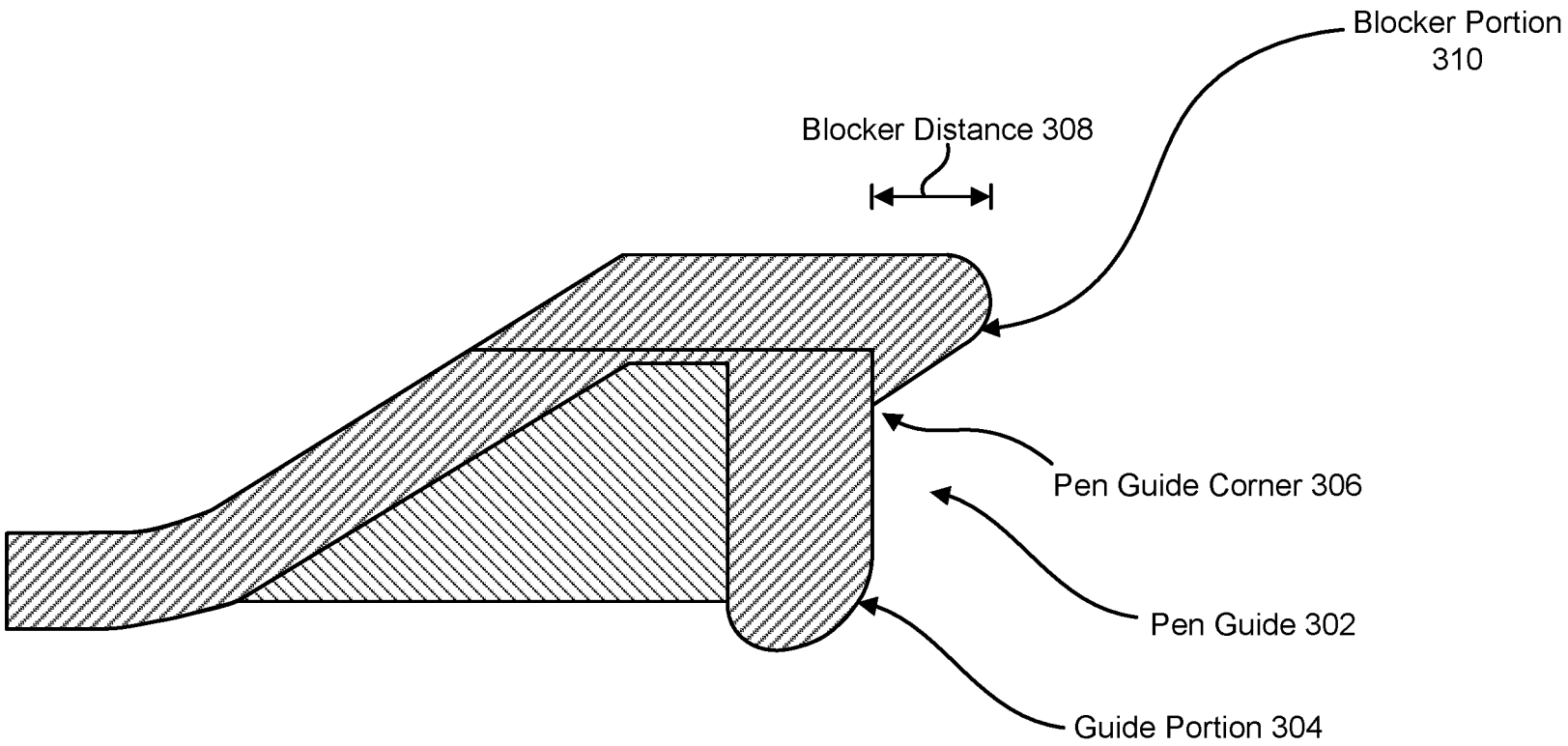
FIG. 3 is a side cross-sectional view illustrating an example of a pen guide for a fluid ejection system consistent with this specification.

FIG. 3 is a side cross-sectional view illustrating an example of a pen guide 302. The pen guide 302 may include a guide portion 304 and a blocker portion 310. In some examples, the blocker portion 310 may protrude a blocker distance 308 towards the pen chamber 210 of the carriage base 216. The blocker portion 310 may serve to keep the pen 224 away from the dimples 220 on the carriage base 216 rear wall by the blocker distance 308 until the pen 224 engages the pen guide 302. In other words, when placing a pen 224 down into the carriage base 216, the rear of the pen 224 may be kept a distance 308 from the rear wall of the carriage base 216 before the top back corner of the pen 224 engages the pen guide 302, where the distance 308 is determined or defined by the pen guide 302. The guide portion 304 may be connected to the blocker portion 310 to form a pen guide corner 306 that holds the top back corner of the pen 224 during the angular loading of the pen 224. In some examples, the pen guide 302 may be integrated into existing printer parts. In one example, the pen guide 302 may be part of a printer part to provide aerosol protection of a carriage PCA (printed circuit assembly) that may be mounted onto the carriage base 216.

FIGS. 4A-4E are side cross-sectional views illustrating examples of a pen 424 being placed into a carriage base 416 consistent with this specification. More specifically, FIGS. 4A-4E illustrate examples of the angular loading of a pen 424 into a carriage base 416 at different times during the pen 424 installation.

Figure 4A:
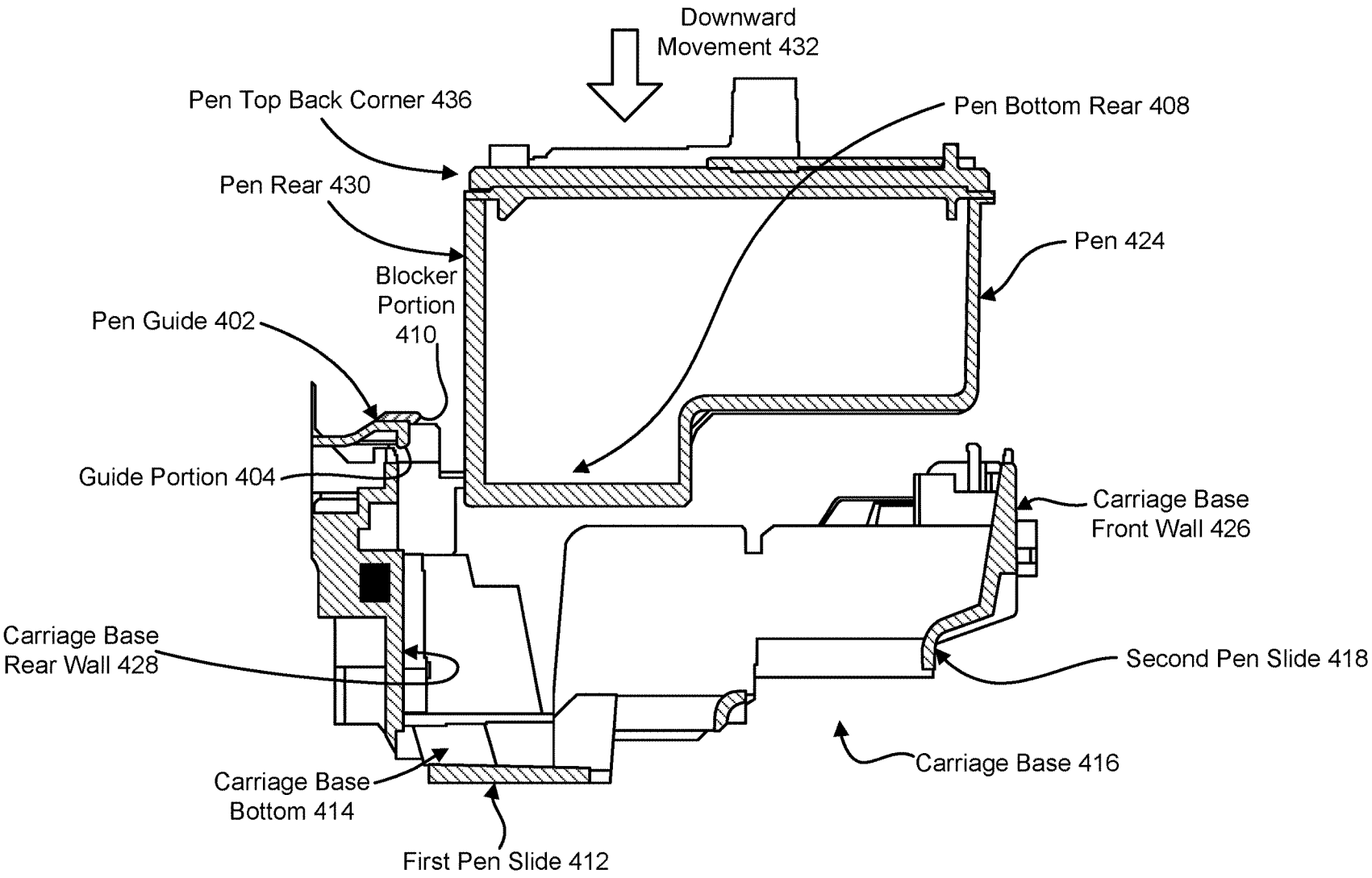
FIGS. 4A-4E are side cross-sectional views illustrating examples of a pen being placed into a carriage base consistent with this specification.

The pen guide 402 may prevent a user from moving the pen 424 backward to substantially prevent touching the dimple flex when the pen 424 is inserted. As a result, the dimples 220 from the dimple flex may not scratch the pen pads 236 at the beginning of the pen installation (FIG. 4A). The pen guide 402 may be positioned so that it does not block pen 424 removal from the carriage base 416.

FIG. 4A is a side cross-sectional view illustrating an example of a pen 424 being placed into a carriage base 416 at a first time T1 consistent with this specification. The carriage base 416 may include a first pen slide 412 at the carriage base bottom 414 at the bottom rear of the carriage base 416. The carriage base 416 may include a second pen slide 418 at the front of the carriage base 416 near the carriage base front wall 426. The second pen slide 418 may be connected to the carriage base front wall. In one example, the pen slides may be integrated into the carriage base 416. Since the pen slides 412, 418 may provide sliding movement 434 for ease of pen insertion, in some examples, the pen slides 412, 418 may be designed in smooth surfaces and some of them have certain slopes and control gaps after pen seating. Certain slopes of the pen 424 during the insertion process are controlled by the height delta between the pen slides 412 and 418. The bigger the height delta, the bigger the slope, which may cause a worse pen insertion experience. The control gaps are controlled by the dimension of the second pen slide 418, which may be referred to as the pen seating Y datum on the carriage base. Tighter gaps may cause difficulty to insert pens. Bigger gaps may cause pens pre-seating instability. The slopes and gaps may not cause any blockage of pen removal.

A pen guide 402 at the top rear of the carriage base 416 disposed at or near the carriage base rear wall 428 may serve to hold a top back corner 436 of a pen 424 during an angular loading of the pen 424. In one example, the pen guide 402 may include a guide portion 404 and a blocker portion 410. At time T1 the pen 424 is moved in a downward movement 432 towards the carriage base 416. The blocker portion 410 of the pen guide 402 serves to keep the pen 424 at least some distance away from the carriage base 416 rear wall 428. In some examples, the distance may be a blocker distance 308. The pen 424 continues in a downward movement 432 until the pen 424 engages the second pen slide 418 causing the pen 424 to be oriented at an angle as shown in FIG. 4B.

Figure 4B:
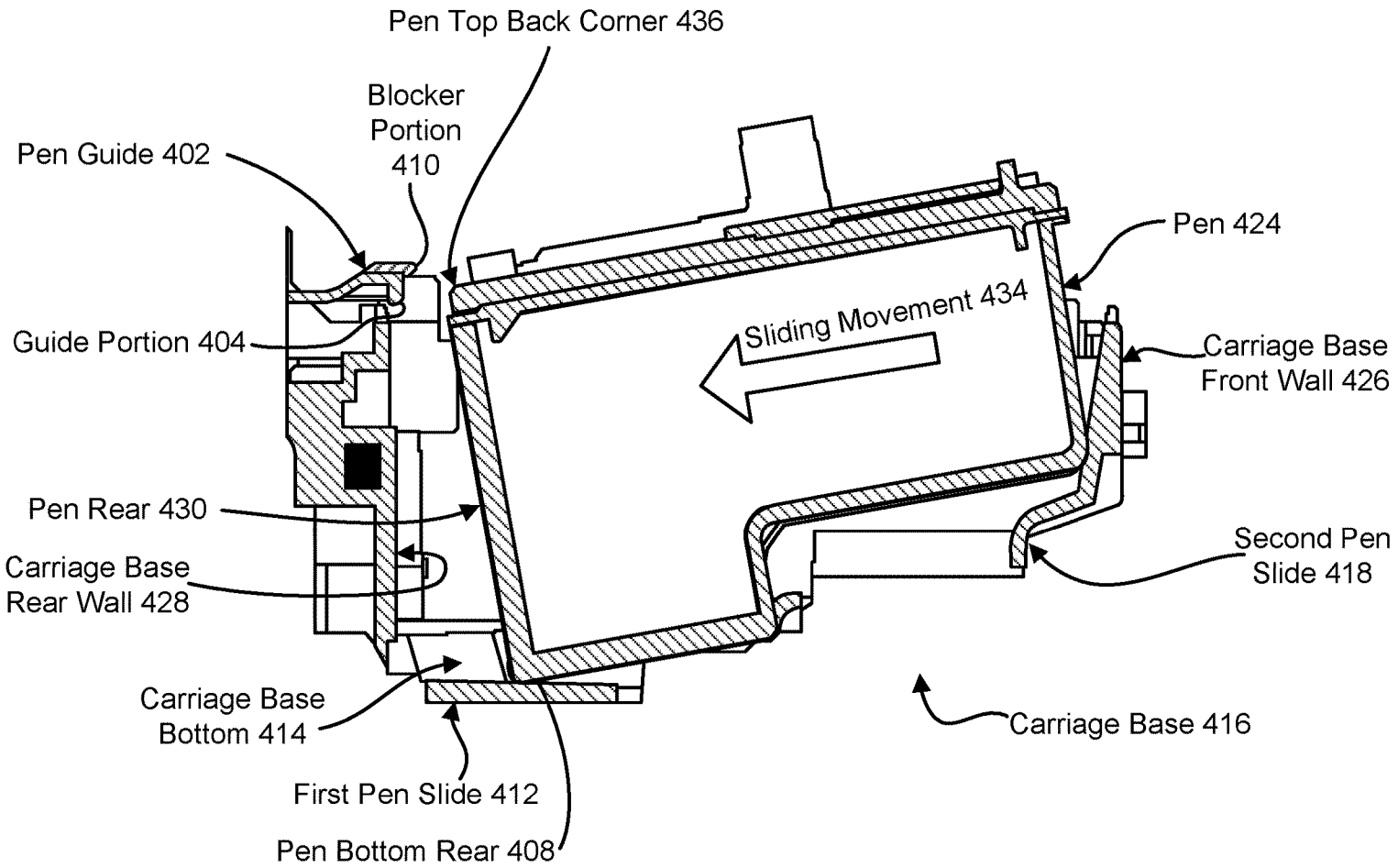

FIG. 4B is a side cross-sectional view illustrating an example of a pen 424 being placed into a carriage base 416 at a second time T2 consistent with this specification. In one example, T2 may be a time after T1. At time T2, the pen 424 may have engaged the second pen slide 418 that causes the pen 424 to be at a slight angle to angularly load the pen 424. The pen bottom rear 408 may engage the first pen slide 412. At time T2 the pen 424 may be engaging both the first pen slide 412 and the second pen slide 418. The pen rear 430 may be a blocker distance or more away from the carriage base rear wall 428. The pen 424 then slides along the first pen slide 412 and the second pen slide 418 towards the carriage base rear wall 428 until the pen top back corner 436 engages the pen guide 402. The pen guide 402 corner holds the top back corner 436 of the pen 424 substantially in place during angular loading of the pen 424. When the pen top back corner 436 engages the pen guide 402, there may still be a gap between the pen pads 236 and the dimples 220 thereby providing some level of scratch protection.

Figure 4C:
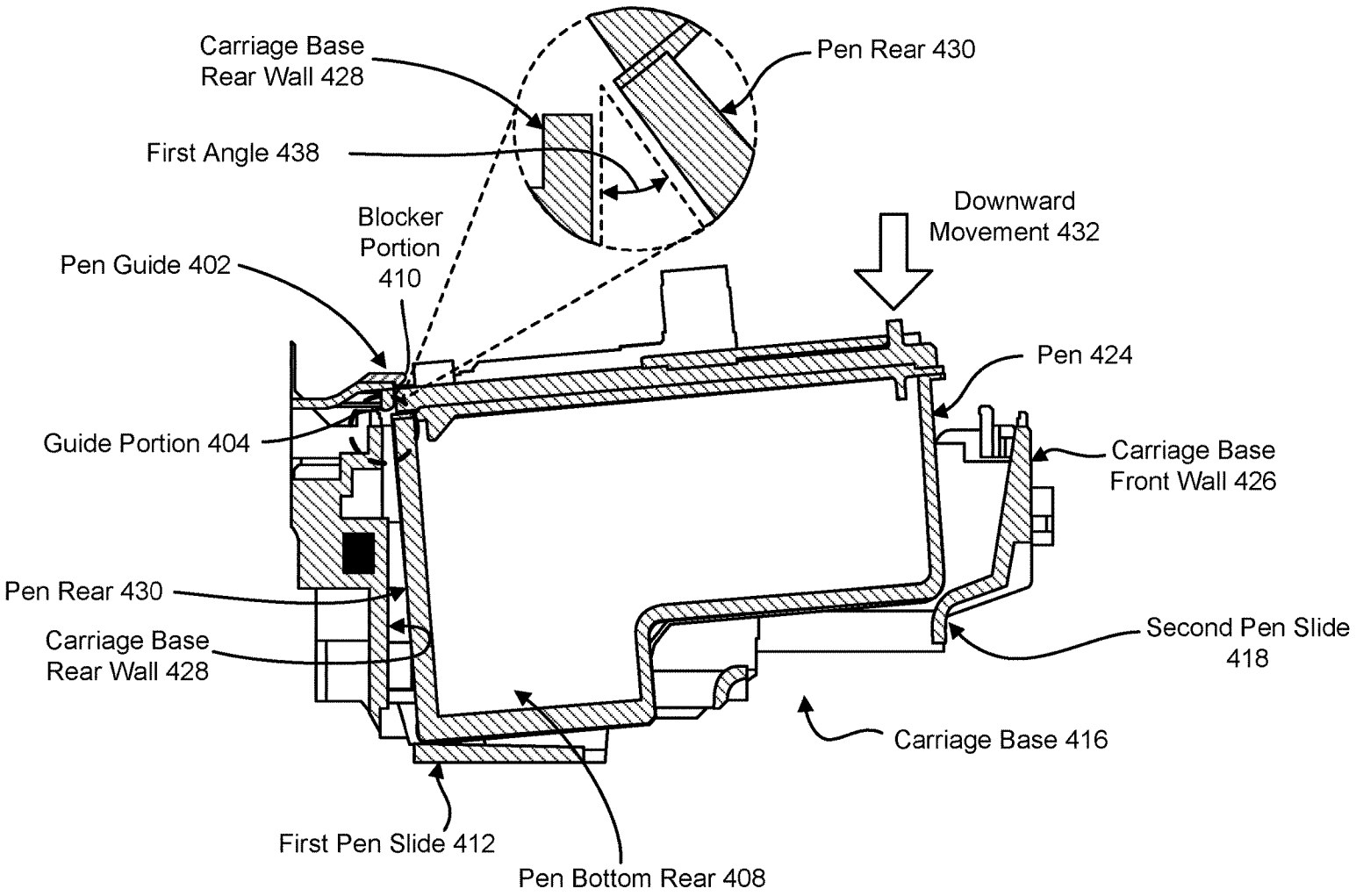

FIG. 4C is a side cross-sectional view illustrating an example of a pen 424 being placed into a carriage base 416 at a third time T3 consistent with this specification. In one example, T3 may be a time after T2. At time T3, the pen guide 402 corner holds the top back corner 436 of the pen 424 substantially in place during angular loading of the pen 424. FIG. 4C illustrates the angular loading of the pen 424 where the pen 424 is in a first position and where a first angle 438 forms between a rear 430 of the pen 424 and a rear wall 428 of the carriage base 416. In one example, the first angle 438 may be approximately 4.5 degrees when the pen 424 first engages the pen slides 412, 418 and the guide 402 and then may progress to approximately 2.9 degrees right before final insertion. In other examples, the first angle may vary.

Figure 4D:
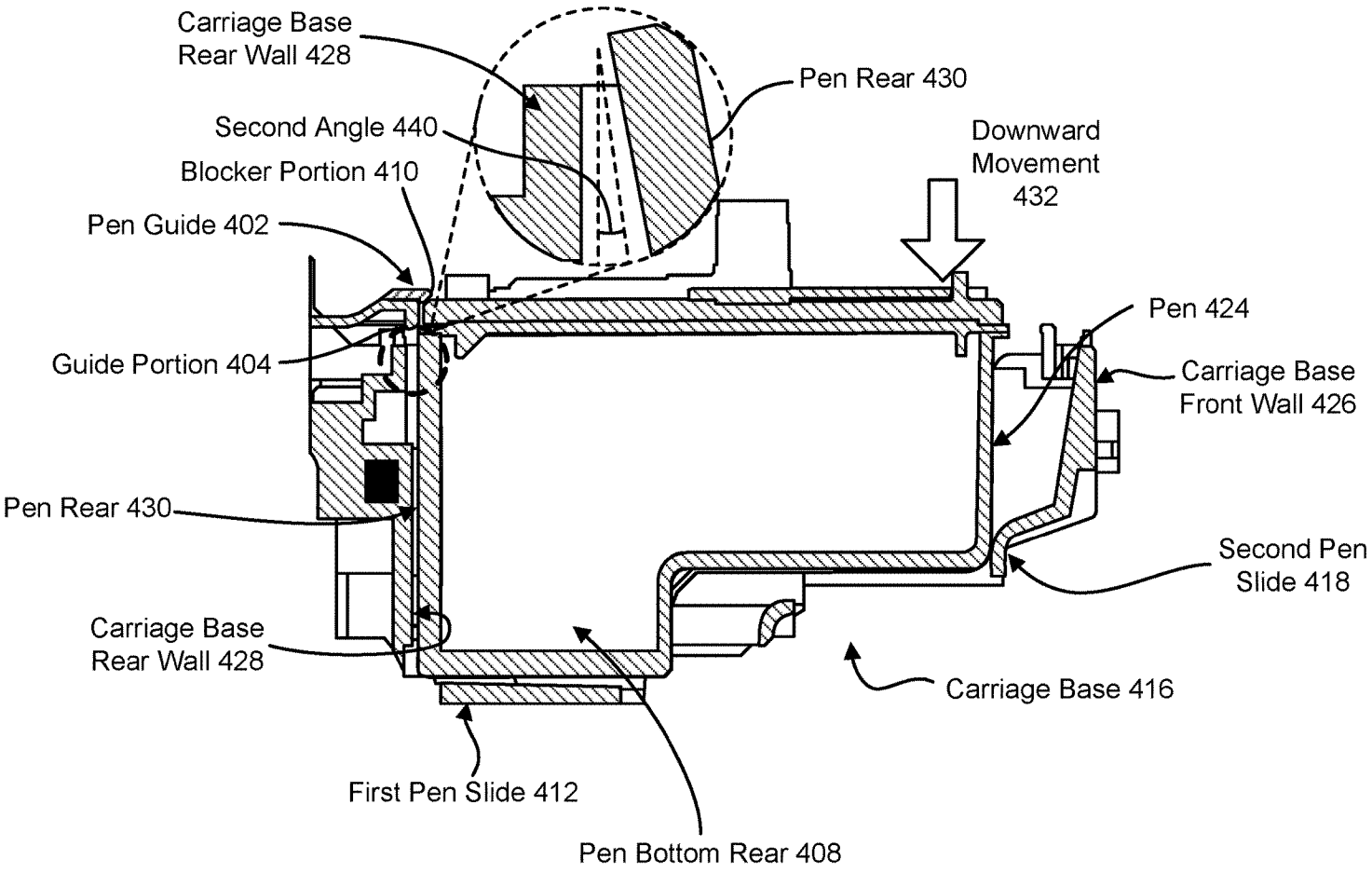

FIG. 4D is at time T4 and illustrates angular loading of the pen 424 at a second position where a second angle 440 forms between the rear of the pen 424 and the rear wall of the carriage base 416. In one example, the first angle 438 may be greater than the second angle 440. T4 may be a time after T3. As shown by FIGS. 4C and 4D, the first position may occur before the second position. From time T3 to T4 shown in FIGS. 4C and 4D, the pen 424 may continue to slide along the first pen slide 412 and the second pen slide 418 towards the carriage base rear wall 428 causing the second angle 440 to be less than the first angle 438.

A user may continue to push downward on the pen 424, pushing the pen 424 into the carriage base 416 whereby the pen 424 is then pre-seated well before latching. During this final push, the dimples 220 may scratch the pen pads 236 to ensure electrical connectivity between the dimples 220 and the pen 424.

Figure 4E:
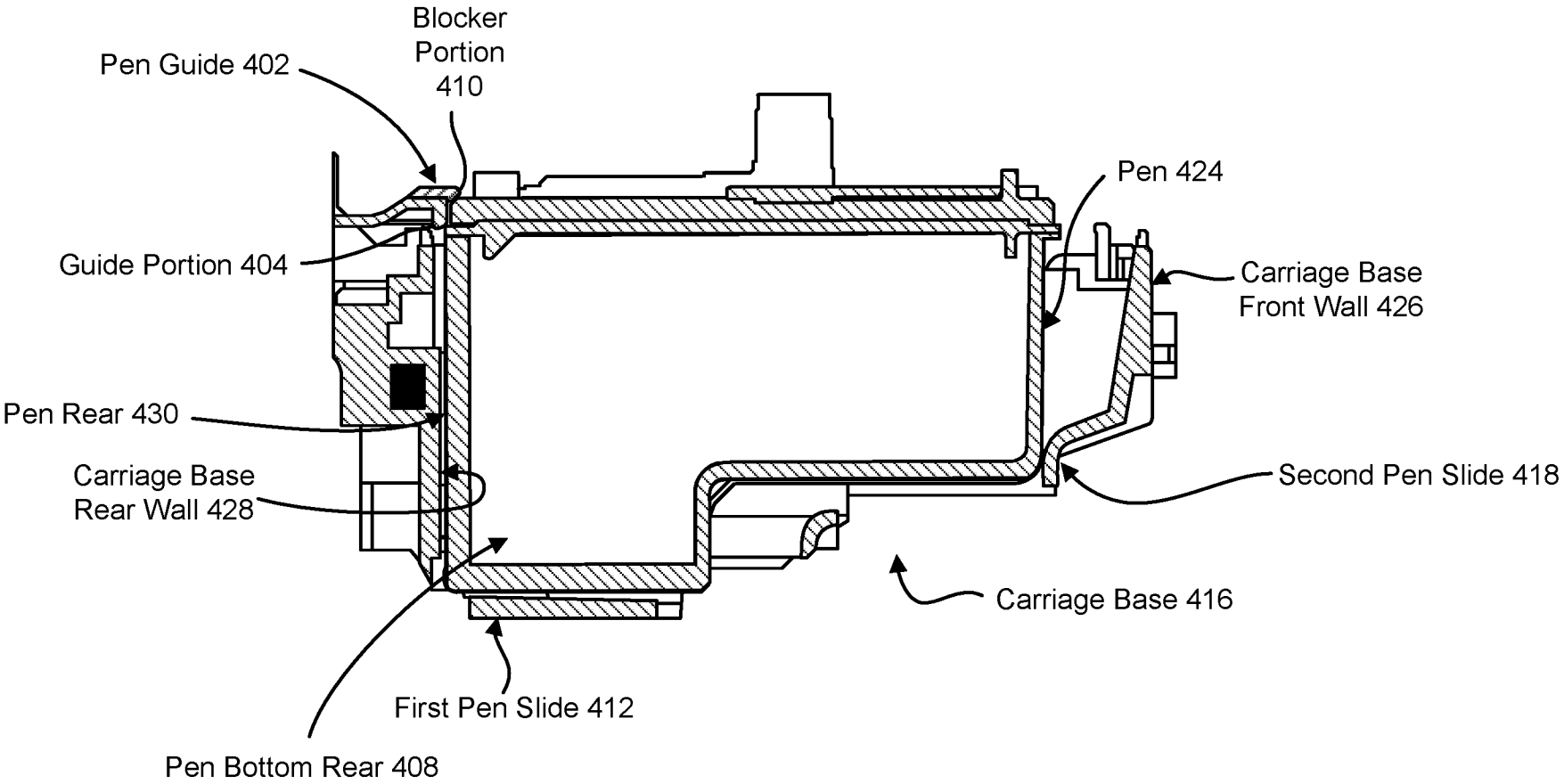

FIG. 4E is a side cross-sectional view illustrating an example of a pen 424 installed into a carriage base 416 at a fifth time T5 consistent with this specification. In one example, T5 may be a time after T4.

Figure 5:
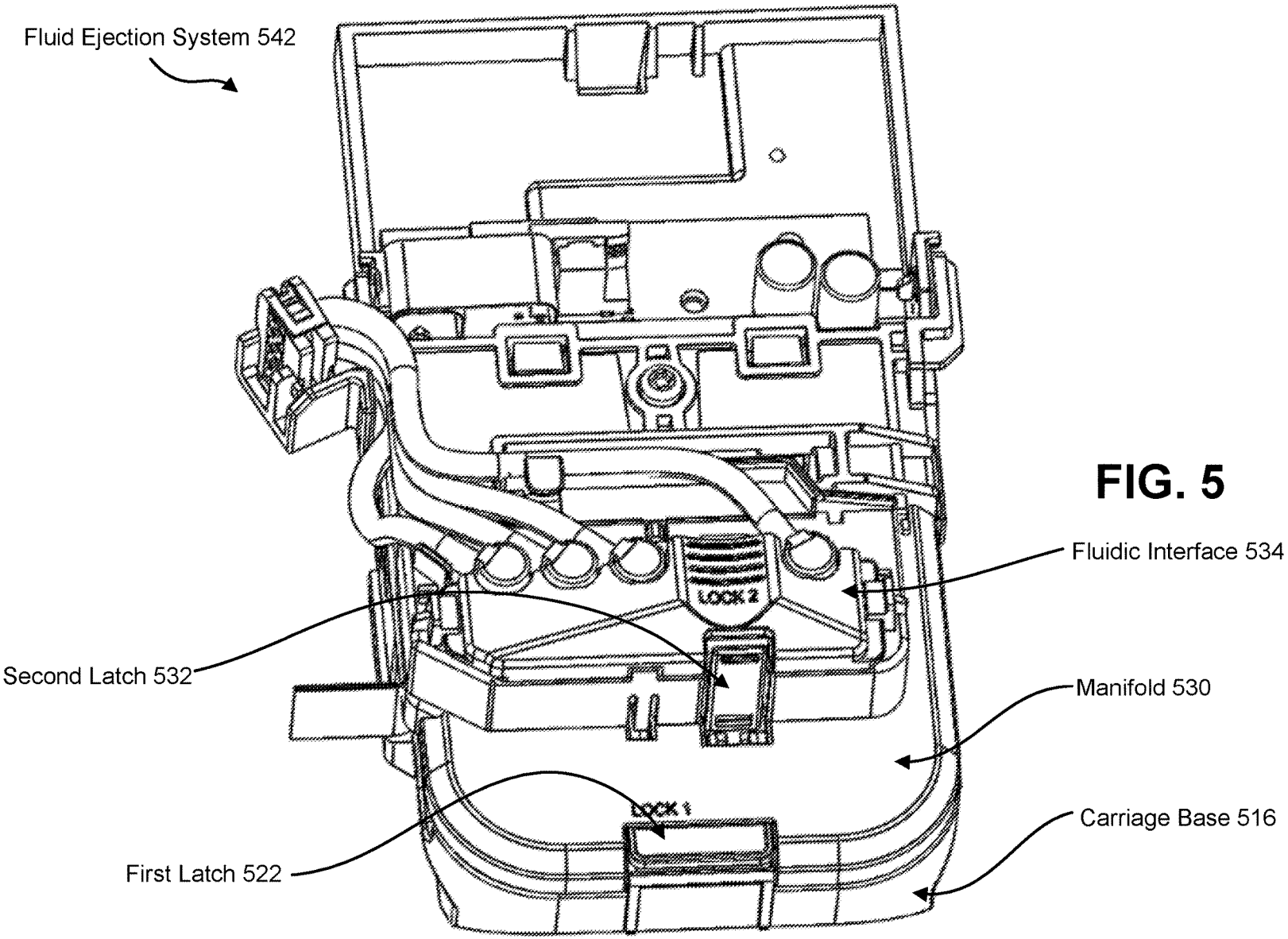
FIG. 5 shows a view of an example fluid ejection system with the manifold and fluidic interface in place in an example consistent with this specification.

FIG. 5 shows a view of an example fluid ejection system 542 with the manifold 530 and fluidic interface 534 in place in an example consistent with this specification. The fluidic interface 534 is mounted on top of the manifold 530. The manifold 530 rests on the carriage base 516. The fluidic interface 534 includes a number of tubes connecting the pens to the associated reservoirs (not shown). FIG. 5 also depicts the first latch 522 and the second latch 532 which secure the manifold 530 to the carriage base 516 and the fluidic interface 534 onto the manifold 530, respectively.

Figure 6:
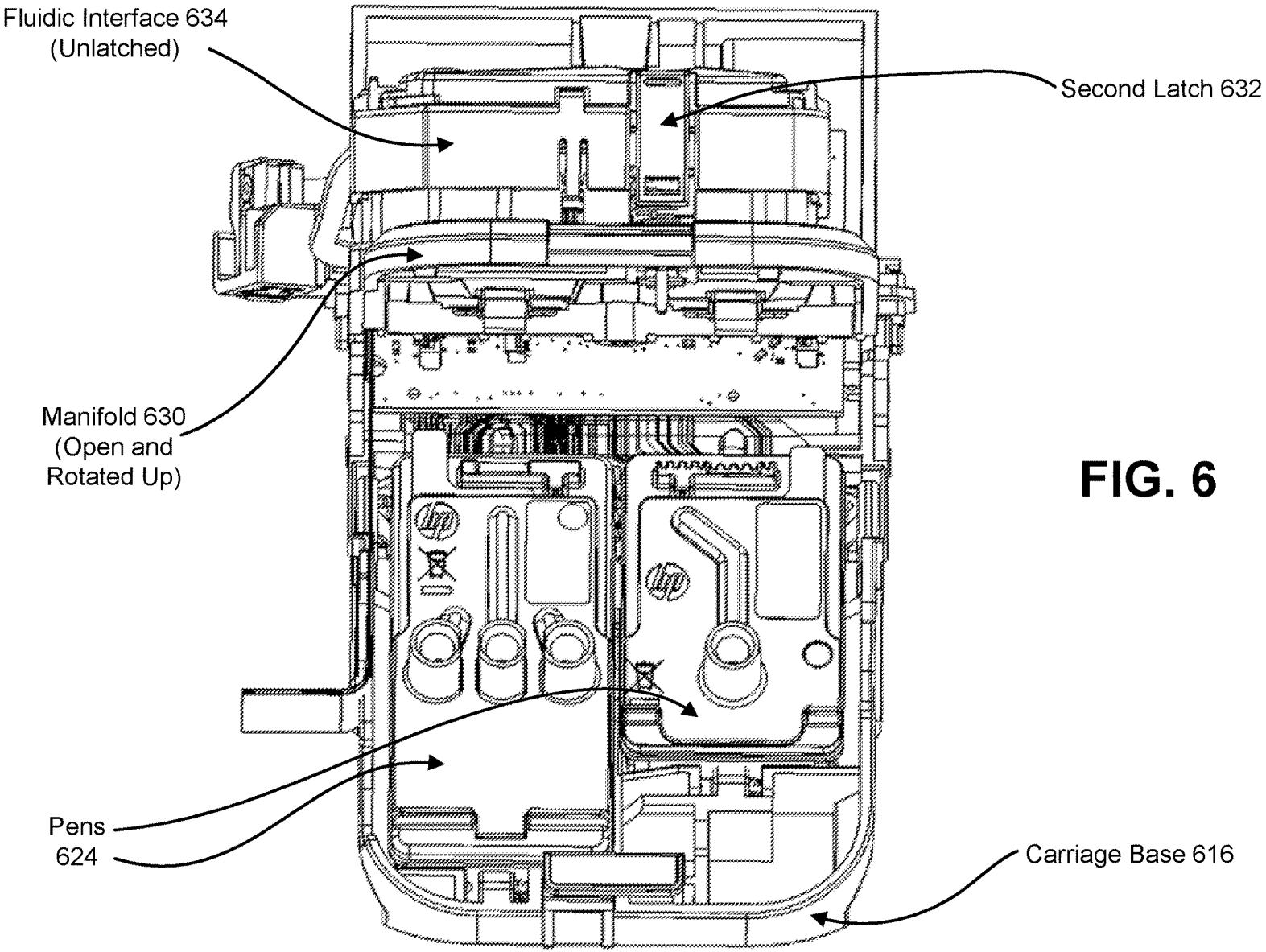
FIG. 6 shows a top view of an example carriage base with the manifold and fluidic interface rotated upward in an example consistent with this specification.

FIG. 6 shows a top view of an example carriage base 616 with the manifold 630 and fluidic interface 634 rotated upward and out of the way. The pens 624 are visible on the carriage base 616. The rotation of the manifold 630 provides easy access to the pens 624 and allows loading the pens 624 to be readily accomplished. The fluidic interface 634 is resting on the sliding surface of the manifold 630 but is not latched in place. Once the manifold 630 is rotated down over the pens 624, the fluidic interface 634 may be placed onto the manifold 630 and latched with the second latch 632.

Figure 7:
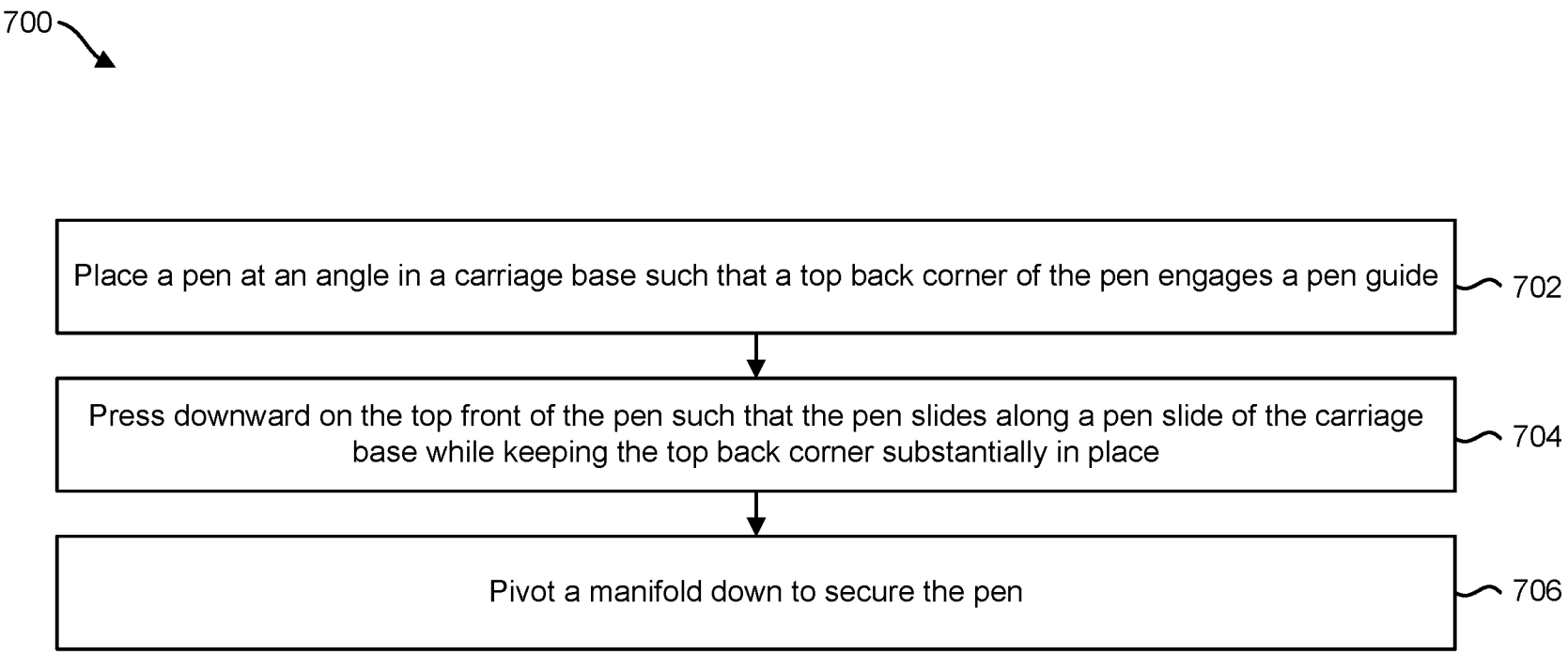
FIG. 7 is a flow diagram illustrating an example method of angular loading of a pen into a carriage base consistent with this specification.

FIG. 7 is a flow diagram illustrating an example method 700 consistent with this specification for preparing a fluid ejection system for use. The method 700 may include placing 702 a pen 424 at an angle in a carriage base 416 such that a top back corner of the pen 424 engages a pen guide 402. The method 700 may also include pressing 704 downward on the top front of the pen 424 such that the pen slides along a pen slide of the carriage base 416 while keeping the top back corner substantially in place. The method 700 may also include pivoting 706 a manifold down to secure the pen 424.

Figure 8:
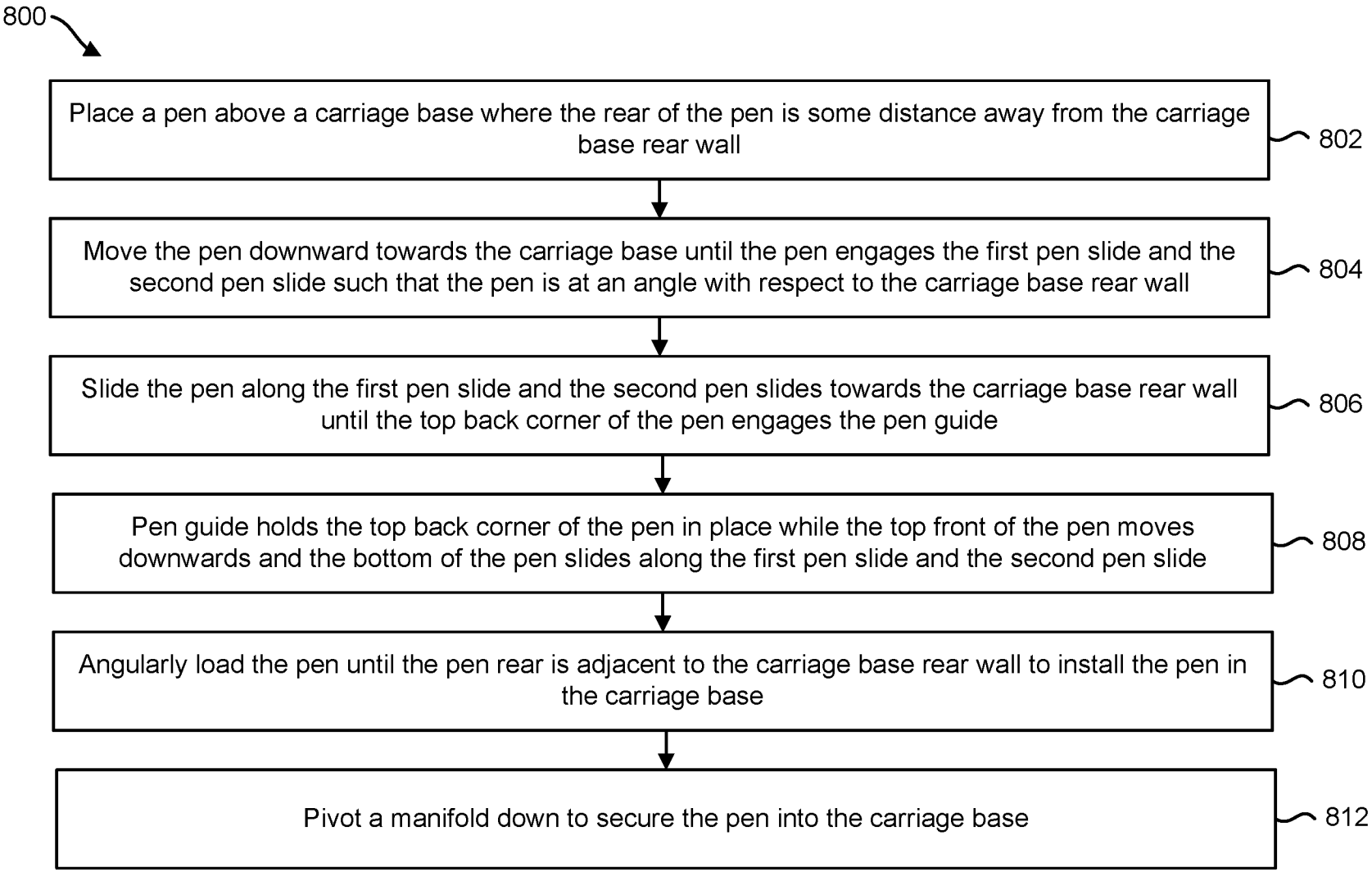
FIG. 8 is a flow diagram illustrating an example method of angular loading of a pen into a carriage base consistent with this specification.

FIG. 8 is a flow diagram illustrating an example method 800 consistent with this specification. The method 800 may include placing 802 a pen 424 above a carriage base 416 where the rear of the pen 424 is some distance away from the carriage base rear wall 428. The method 800 may include moving 804 the pen 424 downward towards the carriage base 416 until the pen 424 engages the first pen slide 412 and the second pen slide 418 such that the pen 424 is at an angle with respect to the carriage base rear wall 428. The pen 424 may be slid 806 along the first pen slide 412 and the second pen slides 418 towards the carriage base rear wall 428 until the top back corner of the pen 424 engages the pen guide 402. The top back corner of the pen 424 is held 808 substantially in place by the pen guide 402 while the top front of the pen 424 moves downwards and the bottom of the pen slides along the first pen slide 412 and the second pen slide 418. The pen 424 may continue to be angularly loaded 810 until the pen rear 430 is adjacent to the carriage base rear wall 428 to install the pen 424 in the carriage base 416. The method 800 may also include pivoting 812 a manifold down to secure the pen 424 into the carriage base 416.

As used herein, the term "and/or" may mean an item or items. For example, the phrase "A, B, and/or C" may mean any of: A (without B and C), B (without A and C), C (without A and B), A and B (but not C), B and C (but not A), A and C (but not B), or all of A, B, and C.

While various examples are described herein, the disclosure is not limited to the examples. Variations of the examples described herein may be within the scope of the disclosure. For example, aspects or elements of the examples described herein may be omitted or combined.

What is claimed is:

1. A carriage base for a fluid ejection system, the carriage base comprising:
- a first pen slide at a bottom rear of the carriage base;
- a second pen slide at a front of the carriage base; and
- a pen guide at a top rear of the carriage base, the pen guide comprising:
  - a guide portion to engage a substantially vertical portion of a top back corner of a pen;
  - a blocker portion to engage a substantially horizontal portion of the top back corner of the pen; and
  - a pen guide corner formed at a connection between the guide portion and the blocker portion of the pen guide to hold the top back corner of the pen substantially in place during an angular loading of the pen.

2. The carriage base of claim 1, wherein the second pen slide is positioned higher than the first pen slide on the carriage base.

3. The carriage base of claim 1, wherein the first pen slide is substantially horizontal.

4. The carriage base of claim 1, wherein the second pen slide comprises a segment that is substantially vertical.

5. The carriage base of claim 4, wherein the second pen slide further comprises a portion that curves away from the first pen slide.

6. The carriage base of claim 5, wherein the second pen slide connects to a carriage base front wall.

7. The carriage base of claim 1, wherein the second pen slide comprises a segment that curves inward toward a pen chamber in the carriage base.

8. A system for loading a pen in a fluid ejection system, the system comprising:
- a manifold; and
- a carriage base attached to the manifold by a rotational connector at a rear of the carriage base, the carriage base comprising:
  - a pen slide at a bottom of the carriage base; and
  - a pen guide at a top rear of the carriage base, the pen guide comprising:
    - a guide portion to engage a substantially vertical portion of a top back corner of a pen;
    - a blocker portion to engage a substantially horizontal portion of the top back corner of the pen; and
    - a pen guide corner formed at a connection between the guide portion and the blocker portion of the pen guide to hold the top back corner of the pen substantially in place during an angular loading of the pen.

9. The system of claim 8, wherein the blocker portion protrudes towards a pen chamber in the carriage base.

10. The system of claim 9, wherein the pen guide protrudes a first distance into the pen chamber to keep the pen away from a carriage base rear wall by the first distance until the pen engages the pen guide.

11. The system of claim 8, wherein the pen slide is integrated into the carriage base.

12. A method for preparing a fluid ejection system for use, comprising:
- placing a pen at an angle in a carriage base such that a top back corner of the pen engages a pen guide comprising:
  - a guide portion to engage a substantially vertical portion of the top back corner of a pen;
  - a blocker portion to engage a substantially horizontal portion of the top back corner of the pen; and
  - a pen guide corner formed at a connection between the guide portion and the blocker portion of the pen guide;
- pressing downward on a top front of the pen such that the pen slides along a pen slide of the carriage base while keeping the top back corner substantially in place at the pen guide corner of the pen guide; and
- pivoting a manifold down to secure the pen.

13. The method of claim 12, further comprising:

forming a first angle between a rear of the pen and a rear wall of the carriage base; and forming a second angle between the rear of the pen and the rear wall of the carriage base, wherein the first angle is greater than the second angle.

14. The method of claim 13, further comprising placing the pen down into a carriage base such that a rear of the pen is at a distance from the rear wall of the carriage base before the top back corner of the pen engages the pen guide, and wherein the distance is determined by the pen guide.

15. The method of claim 12, wherein the pen sliding along the pen slide of the carriage base comprises the pen sliding along a first pen slide and a second pen slide.

* * * * *